US007269987B2

(12) United States Patent
Ollis

(10) Patent No.: US 7,269,987 B2
(45) Date of Patent: Sep. 18, 2007

(54) METHOD OF MANUFACTURING CONNECTING DEVICES

(76) Inventor: William Henry Ollis, 6a Church End, Haddenham, Buckinghamshire HP17 8AH (GB)

( * ) Notice: Subject to any disclaimer, the term of this patent is extended or adjusted under 35 U.S.C. 154(b) by 0 days.

(21) Appl. No.: 10/344,387

(22) PCT Filed: Aug. 10, 2001

(86) PCT No.: PCT/GB01/03586

§ 371 (c)(1),
(2), (4) Date: May 6, 2003

(87) PCT Pub. No.: WO02/13990

PCT Pub. Date: Feb. 21, 2002

(65) Prior Publication Data

US 2004/0035177 A1 Feb. 26, 2004

(30) Foreign Application Priority Data

Aug. 12, 2000 (GB) ..... 0019786.3

(51) Int. Cl.
*B21D 11/14* (2006.01)

(52) U.S. Cl. ..... 72/64; 72/371

(58) Field of Classification Search ..... 72/64, 72/141, 371, 276, 284
See application file for complete search history.

(56) References Cited

U.S. PATENT DOCUMENTS

| | | | | |
|---|---|---|---|---|
| 497,827 | A | 5/1893 | Sellers | |
| 1,549,140 | A * | 8/1925 | McCurdy | 72/64 |
| 1,607,089 | A * | 11/1926 | Leidecker | 72/64 |
| RE16,768 | E * | 10/1927 | Leidecker | 72/64 |
| 5,107,694 | A * | 4/1992 | Kemp | 72/64 |
| 6,264,403 | B1 * | 7/2001 | Hall et al. | 405/252.1 |

FOREIGN PATENT DOCUMENTS

| | | |
|---|---|---|
| DE | 750 275 | 1/1953 |
| EP | 0 171 250 A2 | 2/1986 |
| EP | 0 402 024 A2 | 12/1990 |
| GB | 2 262 560 | 6/1993 |

* cited by examiner

*Primary Examiner*—Daniel C. Crane
(74) *Attorney, Agent, or Firm*—Fay Sharpe LLP

(57) ABSTRACT

The invention relates to a method of manufacturing a connecting device having common axial core material and a plurality of helical fins, flanges or ridges that extend outwards from the core. The method uses an elongate preform member, and comprises forcing the preform member in the axial direction of its core through a helical deformation arrangement (22) in order to deform the preform member helically.

22 Claims, 14 Drawing Sheets

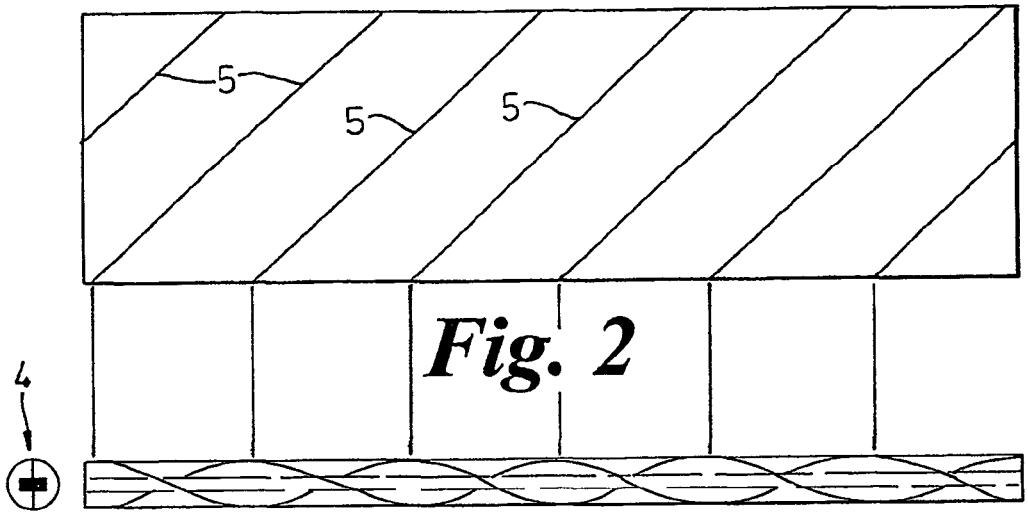
Fig. 2
Fig. 2A
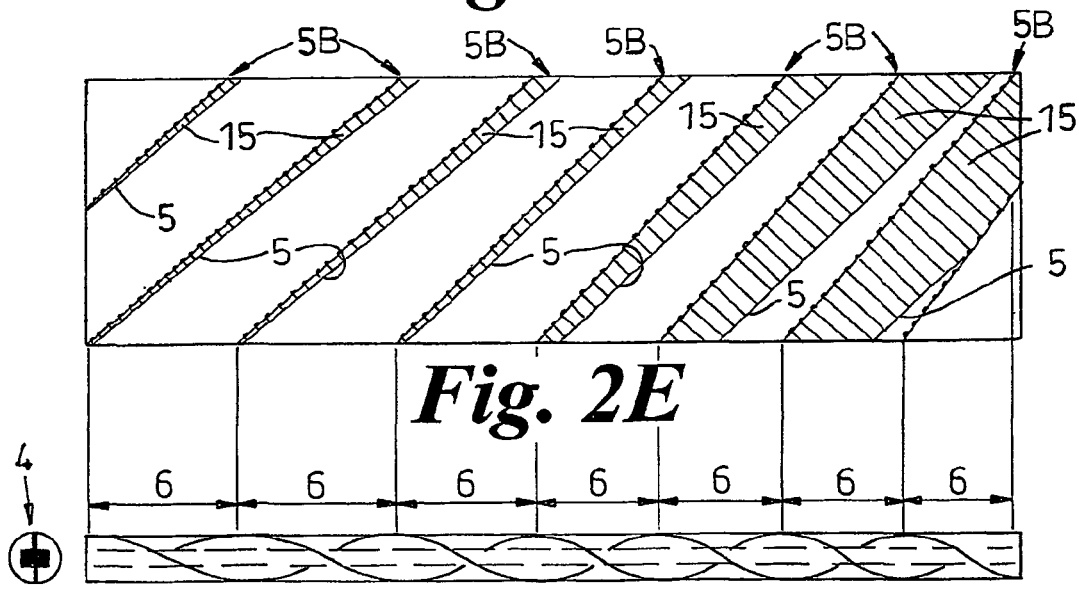
Fig. 2E
Fig. 2B
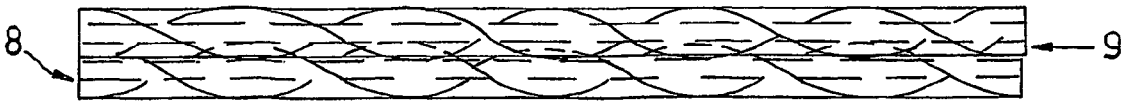
Fig. 2C
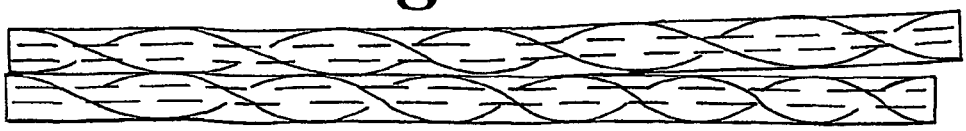
Fig. 2D

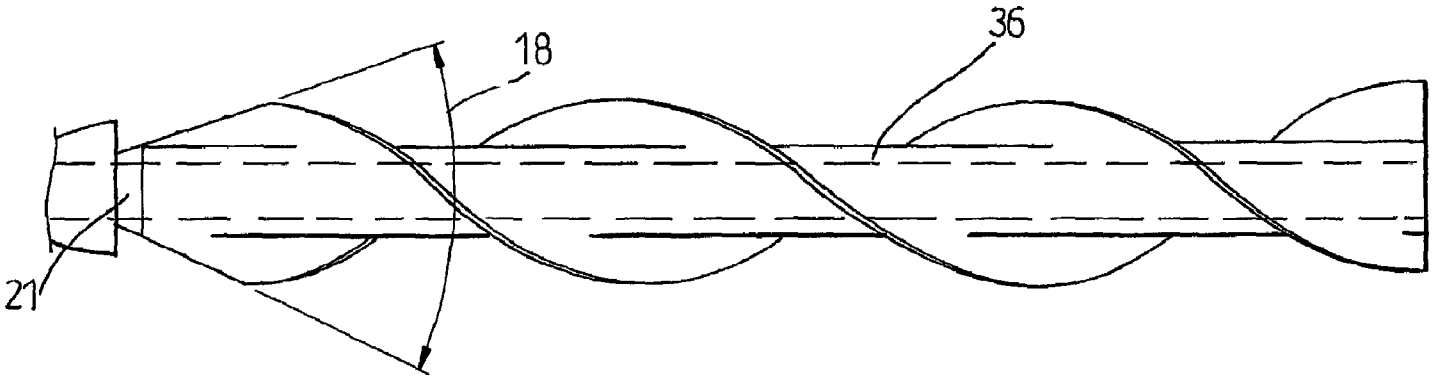
Fig. 6A
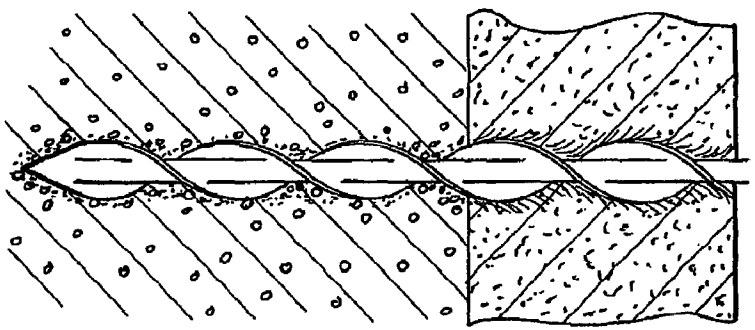
Fig. 6C
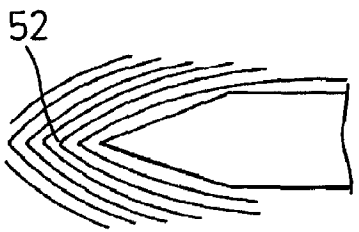
Fig. 6B
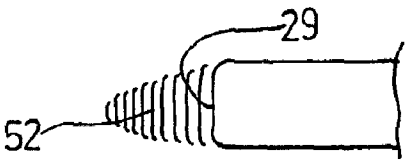

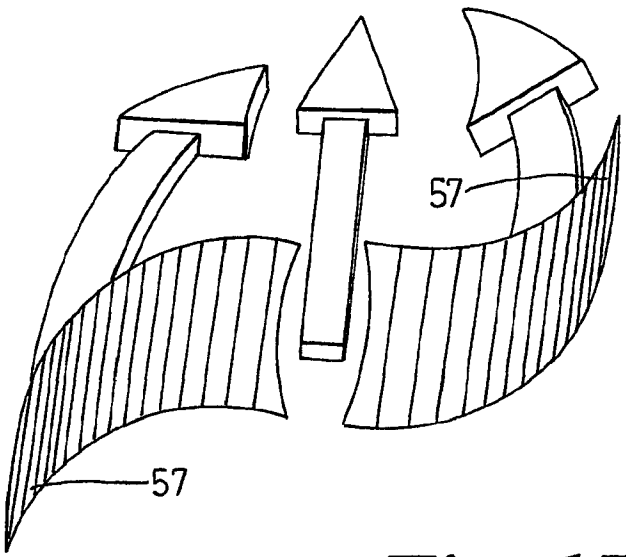
Fig. 17B
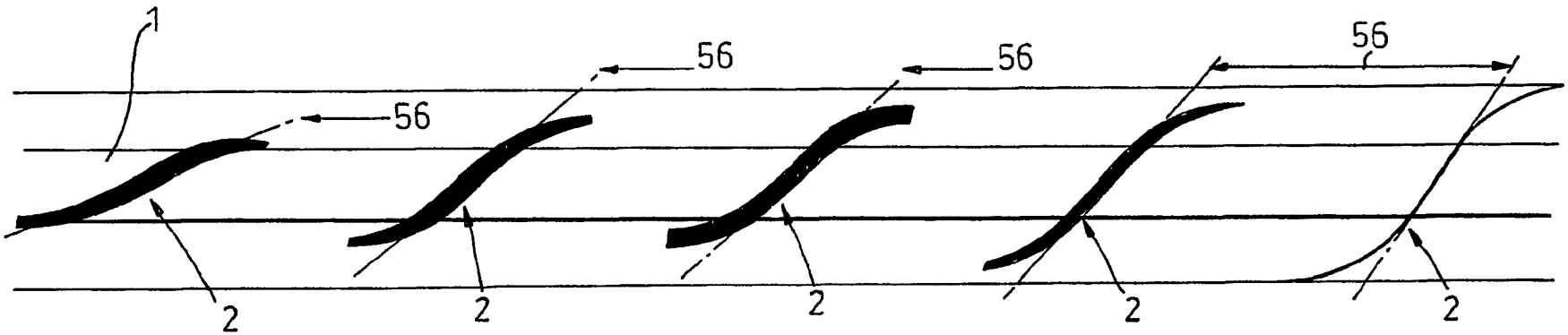

METHOD OF MANUFACTURING CONNECTING DEVICES

This application is a 371 of PCT/GB01/03586, filed Aug. 10, 2001.

The present invention relates to a method of manufacturing various types of connecting devices, which could for example take the form of nails, fasteners, ties or reinforcements. In particular but not exclusively, the application concerns torsional deformation arrangements through which lengths of metal, having two or three major radial fins projecting from a central core, are pushed to give them helical configurations; so that they can provide a screw-like grip in a wide variety of softer or lower density materials used by construction industries, when driven axially into or embedded into them. The radially finned helical products envisaged are similar to ones described in EP 0494099 and EP 0171250 and may be used to serve as ties, reinforcements, fixings and/or fasteners. Grooved rollers or other means can be used to push wires, rods or extrusions through helical deformation arrangements to form the connecting devices.

At present, such wires are given a helical configuration by gripping opposite ends of long lengths of wire and then spinning one end whilst the other is held stationary. It has been found that present methods of providing helical configurations are unreliable and limiting in a number of important respects. The helical pitch is liable to vary along a length of wire being twisted, to an unacceptable extent. Published tolerances on such wires are as much as plus or minus 2 mm on a 40 mm pitch, creating a discrepancy of up to 10%. Variation occurs wherever there is a slight change in metal or geometric characteristics, which inevitably happens at the ends. This is because the ends have to be gripped before any twisting takes place, for a distance sufficient for the torsional forces to be taken at the ends. Such ends do not conform and have to be cut away as waste material. Another problem is that, when a long length is twisted between end grips, its overall length is progressively reduced as it is twisted and it will pull out of its end gripping device unless this device can slide in a spring loaded fashion.

The reasons why it is functionally essential for a helical finned wire to have an accurate constant helical pitch throughout its operational length is explained in detail later with reference to drawings. In essence, if it does not, the grip provided will be largely ineffective when the connecting device is driven into a relatively weak building material such as aerated concrete, because of the destructive passage of helical fins of varying pitches progressing through it. In addition, the resistance induced in driving a helix with a non-uniform pitch, into hard materials, will be greatly increased.

According to the present invention there is provided a method of manufacturing a helical connecting device, the method comprising forcing an elongate preform member through a helical deformation arrangement in order to deform the preform member helically.

The deformation arrangement may have an accelerating pitch, whereby the deformation of the preform member increases as it is forced through the arrangement.

The deformation arrangement may include a substantially straight entry portion.

The deformation arrangement may include an exit portion of substantially constant pitch.

The deformation arrangement may comprise a twisting die.

The twisting die may have a continuous die passageway.

The preform member may include a plurality of weakened zones, and the method may include breaking the deformed preform member at the weakened zones to provide a plurality of connecting devices.

The weakened zones may be shaped such that each connecting device includes at least one sharpened end.

The preform member may be forced through the helical deformation arrangement by means of drive rollers.

According to a further aspect of the invention there is provided a connecting device that is made by a process as defined in the preceding paragraphs, the device including an axial core and a plurality of helical fins that extend outwards from the core.

According to a further aspect of the invention there is provided a connecting device including an axial core and a plurality of helical fins that extend outwards from the core.

According to a second embodiment, the preform member includes a rod-like member, and the method comprises forcing the preform member through the helical deformation arrangement in order to deform the preform member into an open helix.

Advantageously, the diameter of the rod-like member is greater than the external radius of the helical connecting device. The rod-like member may have a circular cross-section or a polygonal cross-section.

The axial core material may have a cross section comprising two-fifths or less of the circumscribed cross sectional area of the device.

The device may include a rear end portion having projecting tabs of material upon the fin material ends.

The device preferably includes two or three major fins extending from the central core.

According to a further aspect of the invention there is provided a connecting device that is made by a process as defined in the preceding paragraphs, the device comprising an open helix. The helical pitch may include at least one full 360° rotation within an axial distance of five and a half circumscribed profile diameters.

Advantageously, the accuracy of pitch varies by no more than 0.5% from any given probate pitch along the axis of the device.

The device preferably comprises a wire, rod or hollow extrusion.

The device may include a front end portion having a profile providing a swept angle of between 20° and 40° inclusive.

The device may include a front end portion having a flat nose end with an area corresponding to between 90% and 40% of the common axial core cross section.

According to a further aspect of the present invention there is provided a method of manufacturing a connecting device having common axial core material and a plurality of helical fins, flanges or ridges that extend outwards from the core, using an elongate preform member, the method comprising forcing the preform member in the axial direction of its core through a helical deformation arrangement in order to deform the preform member helically, such force being carried through the common axial core material the cross sectional area of which is less than 40% of the circumscribed cross-sectional area of the connector.

In a preferred method of manufacturing a fixing device having a central core and two, three or more major helical fins extending along substantially the whole length of the central core, the process comprises forcing a preform member (preferably in the form of a wire, rod or extrusion) through a helical deformation arrangement of accelerating helical compound angles to twist the preform member in such a way that it becomes helical.

Advantageously, the helical deformation arrangement has an acceleration of pitch. Preferably such an arrangement has a substantially straight entry portion.

Advantageously, the preform member (which may be a wire, rod or extrusion) has weakened zones at predetermined intervals in order that lengths may be snapped off after twisting to produce a plurality of fixing devices. Preferably, the weakened zones are shaped so that when it is snapped, each connecting device has at least one pointed end. Helix forming arrangements can be used satisfactorily in conjunction with some other manufacturing techniques, for example, immediately after metal comprising the preform member is extruded through an extrusion die in a molten or semi-plastic state. Helical deformation arrangements advantageously concentrate working heat energy within, a relatively short working zone utilising a warming effect, making the material more malleable. The closest prior art teaches that a circular tube is pulled through a die having a constant helical pitch and a conical void to reduce the central core diameter, as described in EP 150906. However, this method is not applicable to the present invention, in which the input material has been pre-profiled and has solid metal fins. In this context, it is important that the helical deformation arrangement has a straight entry passage, for a radially finned wire, rod or extrusion to enter, reducing significant resistance for a distance sufficient to provide large enough torsional reaction surfaces, ensuring the fin material is not sheared off. It is important that the exit has a helical pitch corresponding with the required pitch of the end products, for a sufficient distance to provide sufficiently high surface area to induce torsional stresses beyond elastic limits.

A preferred version of the invention involves the use of a helical deformation arrangement that provides a continuous passage in which there is a helical acceleration. The pitch accelerates smoothly from zero to the helical compound angle required at the far end. It will be appreciated that surfaces necessary to exert active and reactive forces along the length of the metal section will be available as and where needed along the whole length of the arrangement. With such deformation arrangements a leading end of preform member can be pushed straight into and through such an arrangement. For similar reasons, it is possible to continuously push through such a member, which has already been stamped at intervals to provide lengths of helical material with shaped leading and trailing ends that can be subsequently snapped apart for end use. It will be appreciated that, after a finned material has already been given a helical shape the profiling of the lead or trailing end using a stamping or shearing die will be geometrically much more complicated, in light of various complex compound angles. It will be appreciated that the helical pitch would need to be absolutely regular to enable pre-twisted material to feed into and register efficiently with such intricate stamping die geometry.

The novel method of forming a point profile onto connecting device sections in the preform member, prior to twisting, achieves numerous benefits. The benefits are threefold. Primarily geometric profiles of distinctive form and advantage can now be produced. Secondly the form of the stamping tools can be straight profiled, simply set and resharpened. Finally the tool wear life is prolonged when working upon lesser worked material.

It must also be appreciated that any slight irregularities in the profile prior to helical deformation will be removed as the sections are subsequently forced through the precise helical deflection path.

The helical deformation arrangement will transform the preform section into a helical section with an absolutely true helical path accurate at any one given point to plus or minus half of one percent when measured along the axial length. Where such sections are conventionally twisted (into an imperfect helix), the driven interlock path will inevitably be inaccurate and widened in use, and the mating of the connection slackened. Such slackening effect may also be compounded, during the forming of the lead in point profile, by flash from grinding processes upon the swept fin edges or by post-stamping deformation upon the pointed leading end, or possibly both.

Another two features of such a pre-stamping arrangement are that accurate flat noses can be forged in, and that trailing ends can be given profiles, which can serve as a clamping head. The flattened or blunt nose of the point profile serves the purpose of avoiding splitting and compaction failure of materials into which they are driven. It is common practice to blunt the end of a nail before driving it into a slender timber element to avoid splitting. Alternatively, when driving a spike like point profile into timber, the tendency is for the wood fibres to slither apart longitudinally on either side of the shaft. This tends to induce penetrative spreading forces along the length of a split.

A correct flattening off of the spike-like profile will cause a localised compressive cut through the fibres reducing their tendency to induce splitting resultants.

With non-fibrous materials such as aerated concrete made up of microscopic air bubbles, a spike like point profile creates an enlarged compaction wave of failed material ahead of itself. On the other hand the point profile of any driven fixing, fastening or connector must have a proportion of lead in taper angle as it would otherwise wander if left as a flat cut.

Nails, screws and other fastenings that have stamped points have a spike like profile so they easily separate from one another in production. The method of pre-stamping a profile with a deliberate neck for continual feed, means that a functional flat nose is provided when separation forces are induced across the neck in the subsequent torsional action of helical deformation.

With conventional twisting, the accuracy and tightness of pitch is far slacker than with contained helical deformation arrangements. Those sections that would twist reasonably in the conventional manner with a degree of consistency would have a full common core cross-sectional area of half the entire circumscribed area. This balance is required, as metals commonly have stress and strain behavioural characteristics that are the same in tension as in compression. If the compressed core material falls to within 40% of the entire circumscribed area, there is a strong tendency for the section to become axially distorted as the common core material is insufficient to restrain the stresses induced by the elongate helical path of the radially projecting material With the preferred arrangements a tightness of pitch of one full twist rotation axially within a distance of five and a half circumscribed diameters or less can be achieved. With any twisting action there is a balance of stresses and strains that has to be contained to avoid axial failure upon the core. The outer extremities in the form of either fins or flanges are strained into a tensile mode as they are induced to follow an elongated helical path. These tensile forces are resisted by the inner portion of the section, which is capable of taking such compressive resultants when contained and restrained from axial distortion within an enclosed deformation arrangement.

It should be appreciated that the swept point angle outwardly tapering from the core would follow upon a helical compound angle and would not be of a straight cut. It should also be appreciated that the forming of a single deformation arrangement, with an internal helical configuration, involves difficulties in forming surfaces with complex helical compound curvatures. However, these difficulties can be overcome by means of extensive investment in broaching tooling and the benefits are sufficient to justify their expense. Another benefit of such helical deformation arrangements is that serrated indents and product markings can be rolled onto the section before deformation, without interfering with the smooth deforming operation.

The more onerous profiles to helically deform, even to the slacker end of the spectrum, are tubular sections where there is an added stress characteristic causing tubular collapse. The stresses concentrate themselves at the base of the fins, causing an inward pinching failure. Where such sections have a hollow void with a diameter in excess of a quarter of the full circumscribed diameter these sections would torsionally fail at very slack pitches. Where a contained helical deformation arrangement is used the tubular portion is constrained from collapse and pitches of six or less circumscribed diameters, measured axially, per rotation can be achieved.

EP150906 managed to achieve the desired tightness of pitch by deforming a tube into helical configurations. The tightness of pitch is also a limiting factor upon GB2107017.

However a deformed tube has a low axial strength and limited application. The proposed arrangement resolves these limitations.

It will be appreciated that the use of a single internal helical path can be used to deform non-finned sections in an open helical form. In such axially open form, the deformation arrangement can be used to regulate the amount of common axial core material and thereby control elasticity characteristics. The use of this section as reinforcement, particularly in seismic regions where there is a requirement for elastic yield under load, makes it critical, for axial elasticity, that the helical path is precisely constant.

The open helical form not only provides excellent bond interlock with lower strength cementitious grouts and mortars, but also provides high and accurate levels of mating interlock with other lengths in forming bonded overlaps. Equally when the wires are required to cross intersect, precisely accurate pitch modules and increments maintain positions.

By way of example, embodiments of the invention are now more fully explained and described in terms of various applications, with reference to the following drawings, wherein:

FIGS. 2 and 2A to 2E are side elevations that illustrate and explain the importance of providing helically finned products for use in construction work with helical pitches that are constant throughout, which can be achieved by means of deformation arrangements;

FIGS. 4A to 4D show the complex helical compound curvature of a perfect functional swept angle point and the formation of trailing tab ends, in which FIG. 4A is a cross-section, FIGS. 4B and 4C are side elevations and FIG. 4D is an isometric view;

Figure 7A:
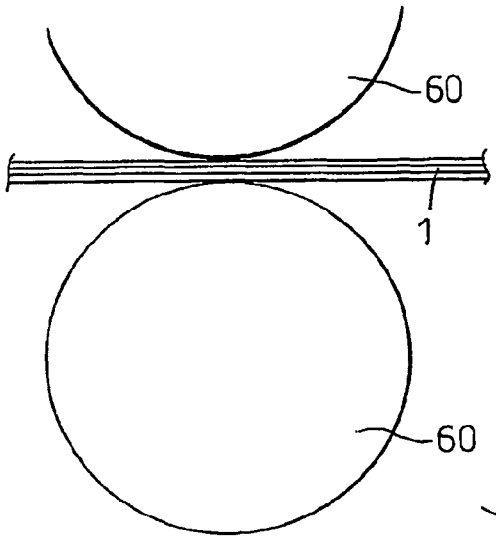
Figure 7B:
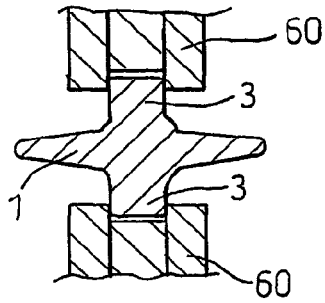
Figure 8A:
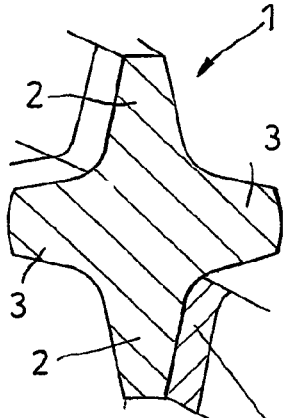
Figure 8B:
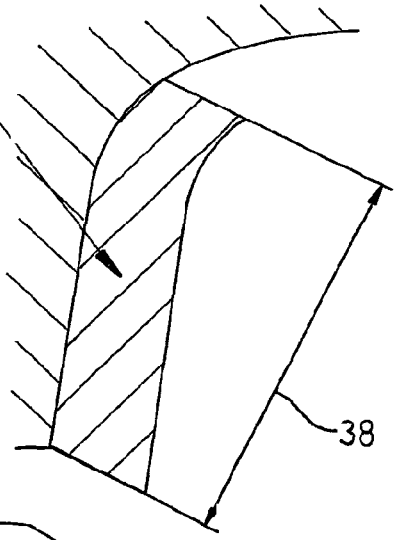
Figure 9:
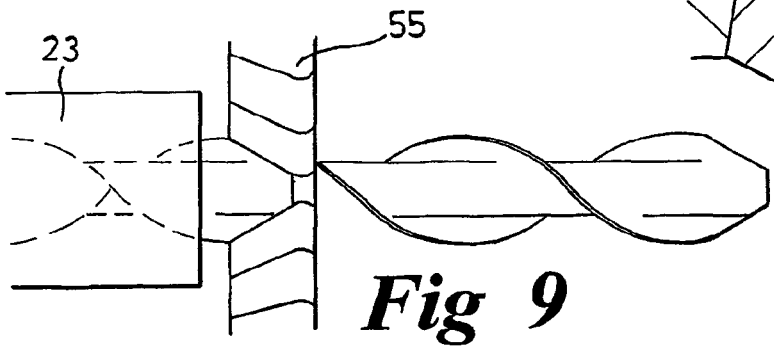
Figure 10A:
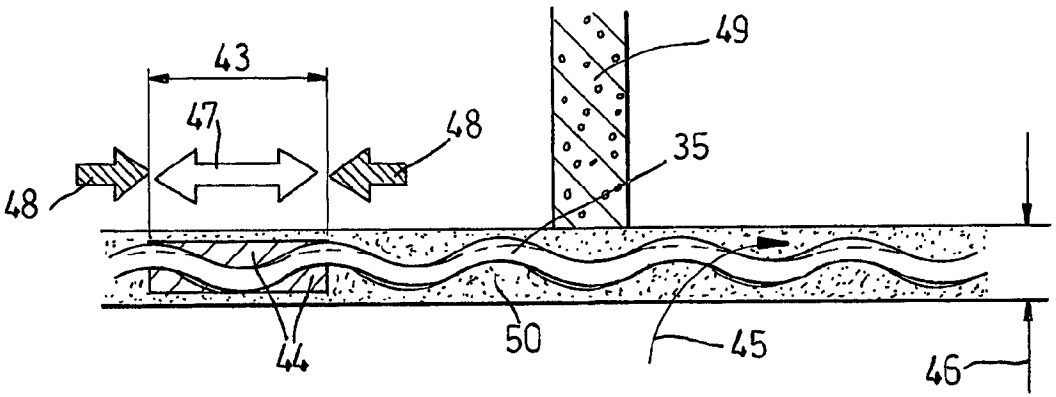
Figure 10B:
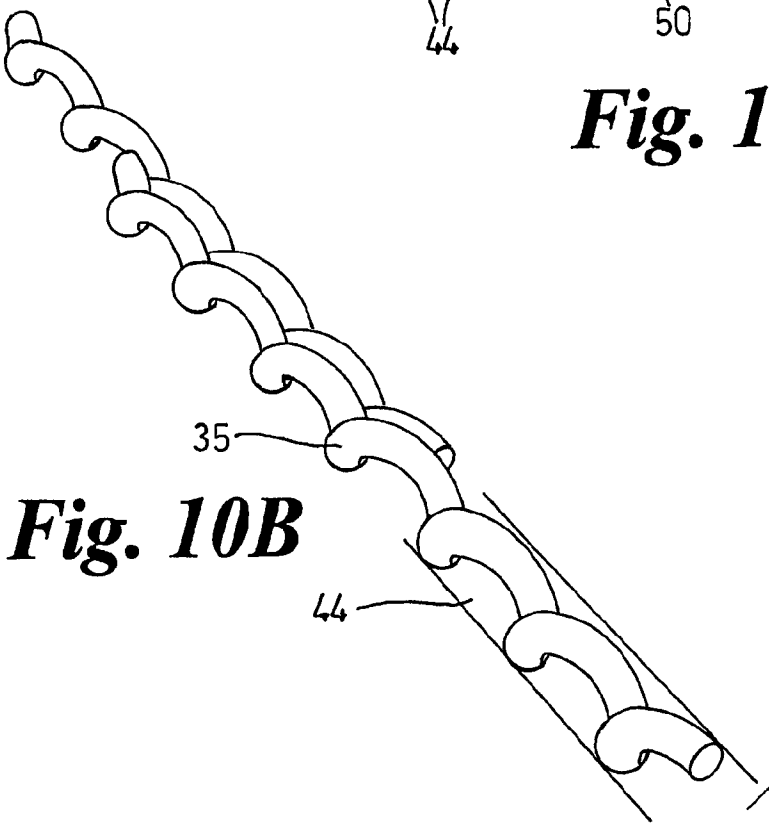
Figure 10C:
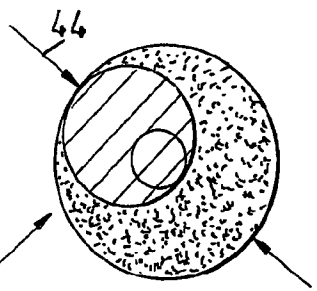
Figure 11A:
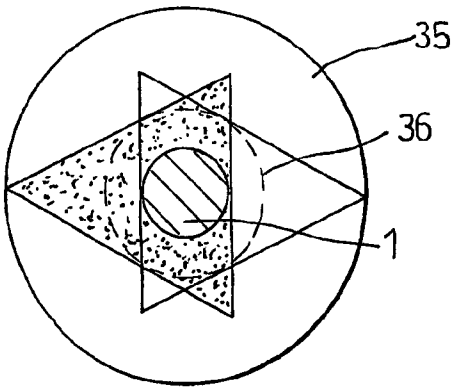
Figure 11B:
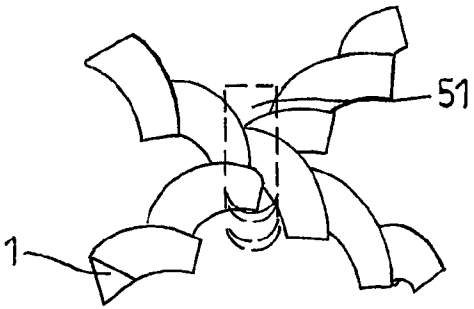
Figure 13A:
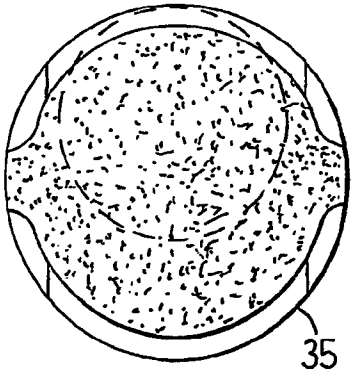
Figure 13B:
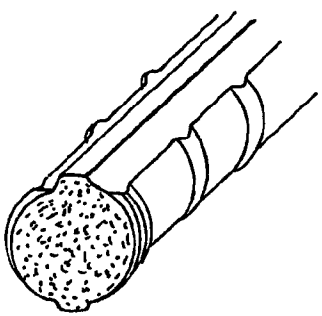
Figure 12A:
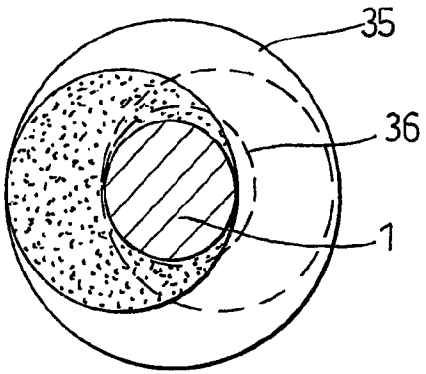
Figure 12B:
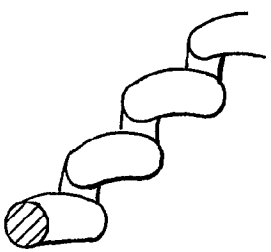
Figure 14:
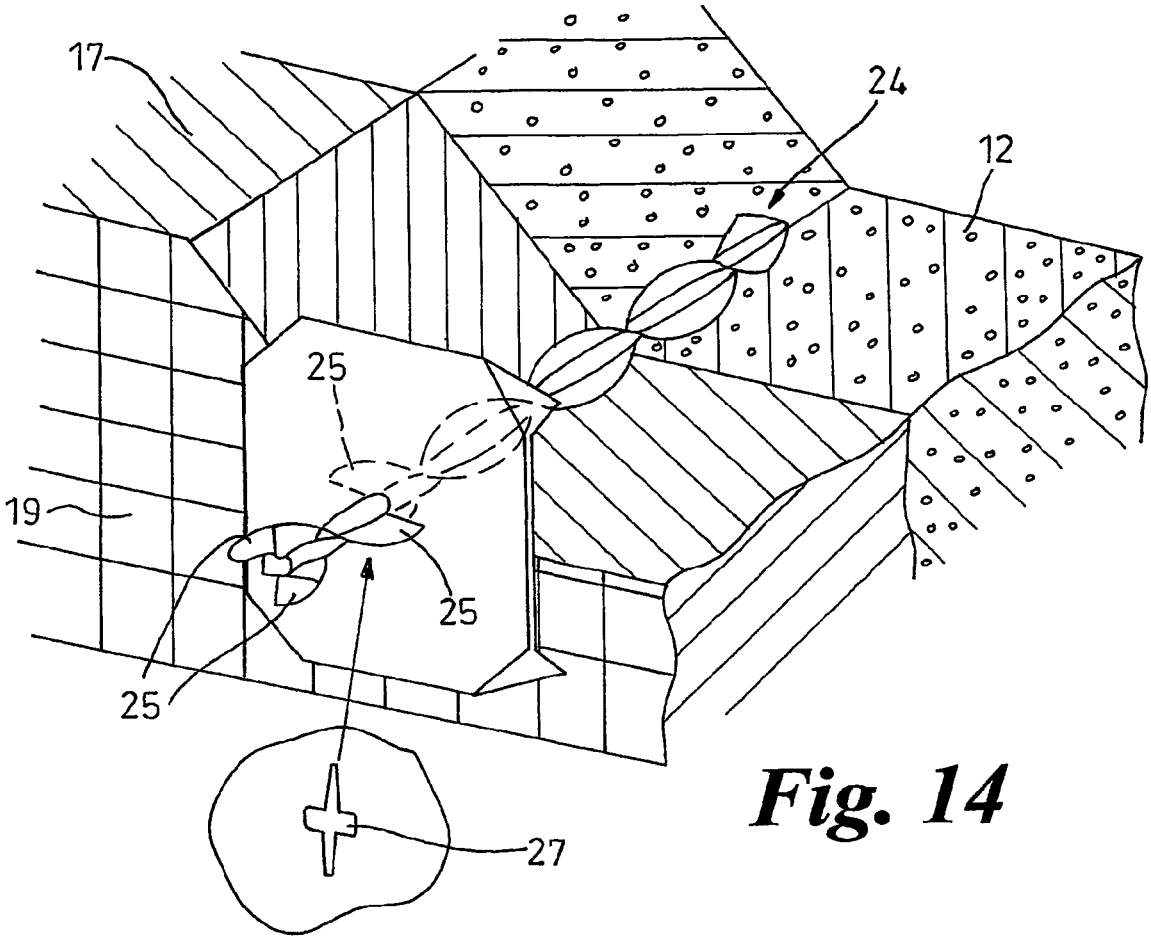

FIGS. 5A to 5D are side elevations that show how helical fixings with regular pitches can conveniently be manufactured with leading and trailing ends having various different profiles for different purposes, by means of a helical deformation arrangement having a pitch which accelerates steadily from zero degrees at the inlet mouth to the pitch required at the exit: a particular example shown is a trailing end with the radial fins extended to form folding over end tabs;

FIGS. 6A to 6C show the ballistic characteristics and compaction pressure wave effects of different point profiles, in which FIGS. 6A and 6B are side elevations, FIG. 6B being at an enlarged scale, and FIG. 6C is a side section;

FIGS. 7A and 7B show a roller arrangement for rolling indents onto a section prior to helical deformation, in which FIG. 7A is a side elevation and FIG. 7B is a cross-section;

FIGS. 8A and 8B are cross-sectional views that show the helical deformation tooling set ups and arrangements of torsional radiused bearing surfaces, FIG. 8B being at an enlarged scale;

FIG. 9 is a side elevation that shows a pointing and parting process for tubular sections;

FIGS. 10A to 10C show the merits of using a round wire that has been deformed into an open helix for reinforcement of masonry walls in both new build and retrospective applications, in which FIG. 10A is a side section, FIG. 10B is an isometric view and FIG. 10C is a cross-section;

FIGS. 11A and 11B show a triangular section deformed into an open helix, FIG. 11A being a cross-sectional view and FIG. 11B being an isometric view;

FIGS. 12A and 12B show around wire form being deformed into an open helix, FIG. 12A being a cross-sectional view and FIG. 12B being an isometric view;

FIGS. 13A and 13B show a conventional reinforcing rod profile a in cross-sectional view and isometric view;

FIG. 14 is an isometric section that shows the use of a helical fixing, with trailing end tabs, to secure layers of composite wall materials, in a way which enables a simple load spreading pressed clip or washer-like retaining head.

Figure 15:
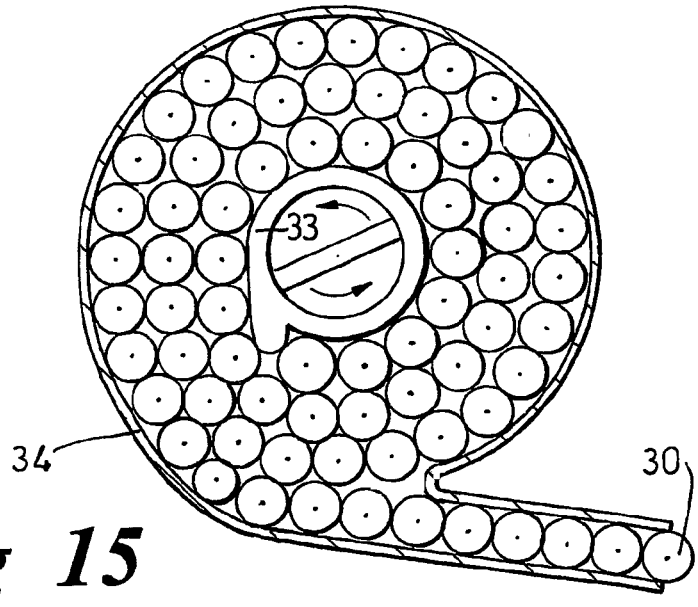
Figure 16A:
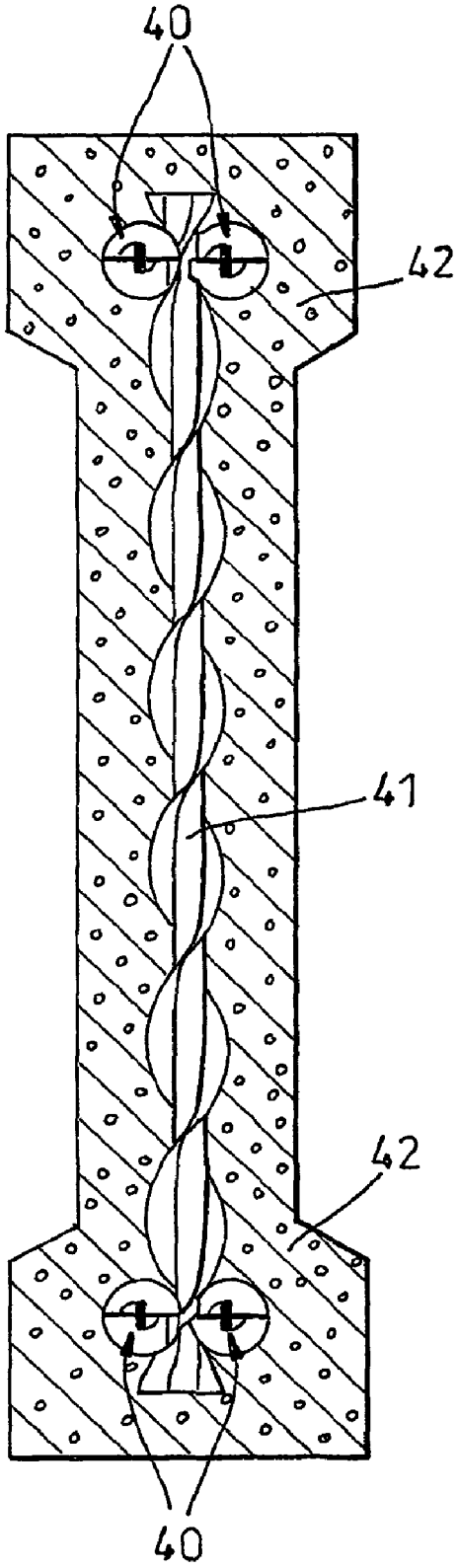
Figure 16B:
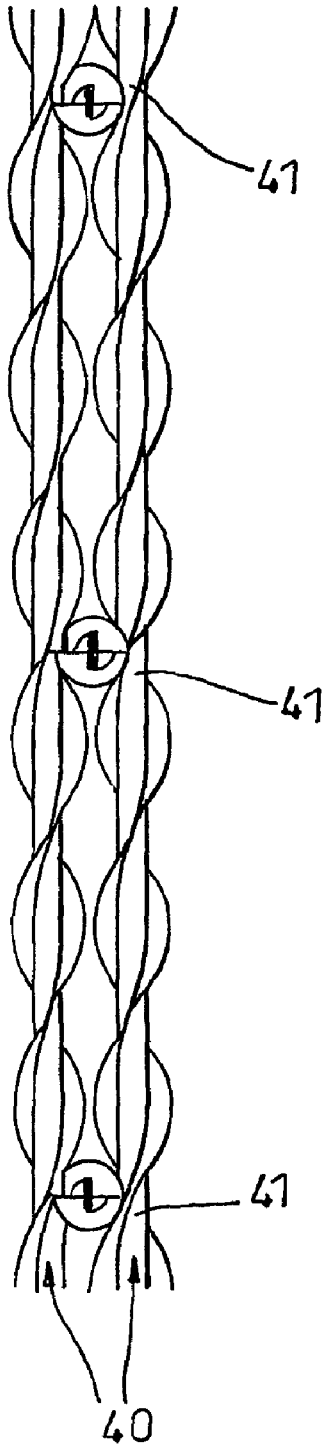
Figure 17A:
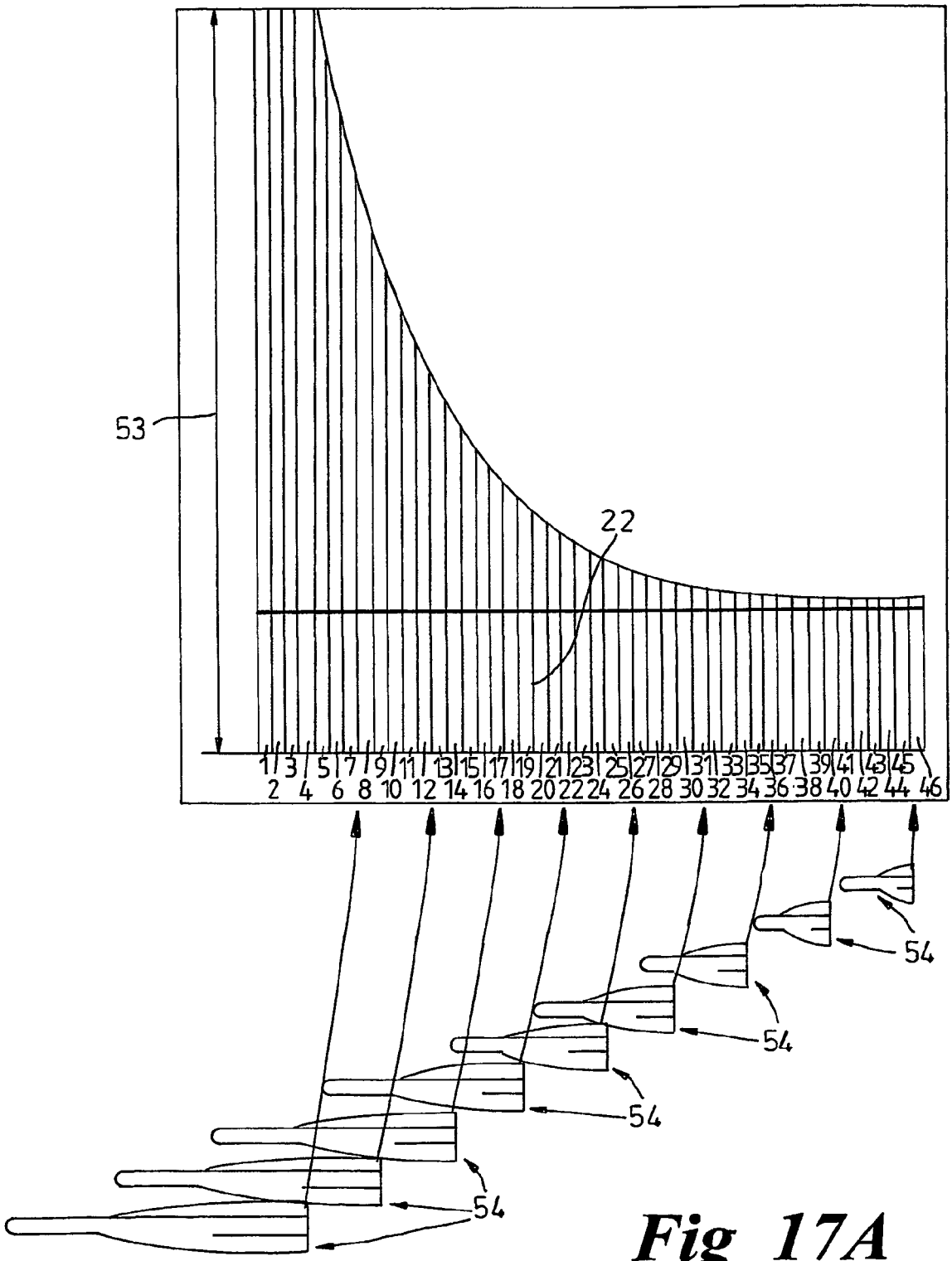

FIG. 15 is a cross-section that shows a bandoleer of collated helical fixings coiled up in a cylindrical container that has an outlet duct so that the fixings can readily be driven by a nailing gun into constructional materials;

FIGS. 16A and 16B are alternative side-sections, which show how radially finned reinforcement wires or rods, with constant helical pitches, can be used to provide reinforcing cages with rods or wires set at right angles to one another;

FIG. 17A is a graphical representation that shows the acceleration path of a typical helical deformation arrangement and the internal increments of angular deflection, and FIG. 17B shows in diagrammatic view how the other two sets of angles related to the longitudinal helical path have to be incorporated within the overall three-dimensional compound angular arrangement.

Figure 1A:
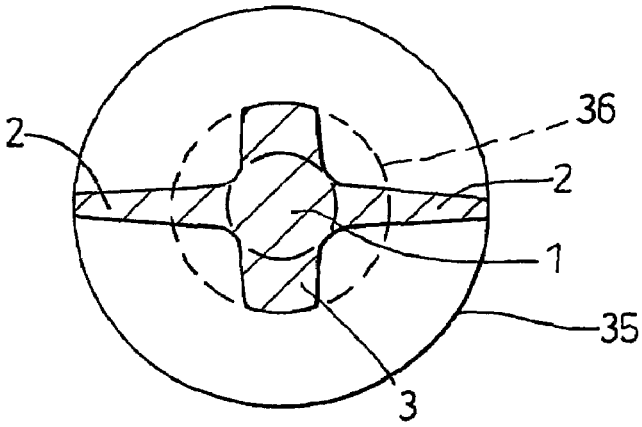
FIGS. 1A to 1I show typical sections with radial fins suitable for being given helical configuration by means of deformation arrangements and demonstrate torsional failure of sections twisted in the conventional fashion.

The figures listed above are now explained in detail below:

FIG. 1A is atypical axial cross-section of a preform member comprising a wire which has been rolled through grooved rolls to form two radial fins (2) projecting from a central core (1) outwardly to the notional effective helical circumscribed diameter (35) with the central core (1) fully contained within the notional circumscribed half diameter cylinder (36). Such a wire can conveniently and advantageously be given a constant helical configuration by pushing a length through a helical deformation arrangement in which both active and reactive torsional forces are applied to the projecting fins (2). It will be appreciated that if the wire being processed is in the form of a very long continuous coil, there will be little loss of working time in having to re-load the apparatus. The preform member also includes a pair of stubby ribs (3) that are created by the rolling process.

Figure 1B:
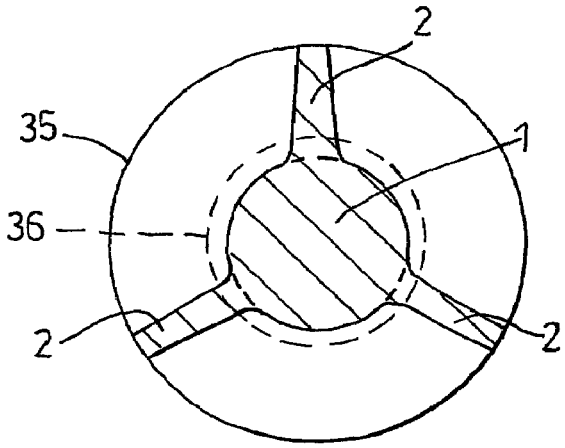

FIG. 1B is a typical section of preform member comprising of a wire with a central core (1) and three radial fins (2). It could, however, easily comprise an extrusion of an aluminium alloy or of some other metal suitable for extrusion.

Figure 1C:
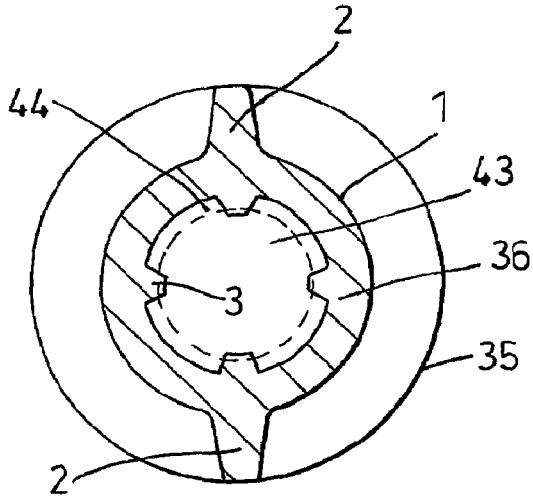

FIG. 1C is a typical section of an aluminium alloy extrusion in which the central core takes the form of a cylindrical tube with a hollow void (43) with nibs (3) projecting into its central void (43).

Figure 1D:
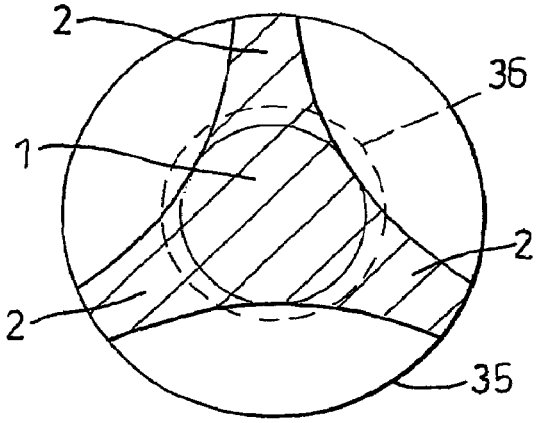

FIG. 1D is a section with three radial fins (2) similar to that in FIG. 1B but the core (1) is provided by the common root material of the fins, such being more convex than normal fins.

Figure 1E:
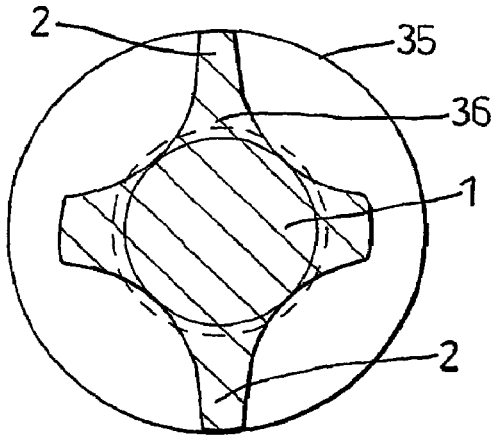

FIG. 1E shows a section very similar to FIG. 1A with radiused inner faces, rolled between two or four rollers in the same fashion.

Figure 1F:
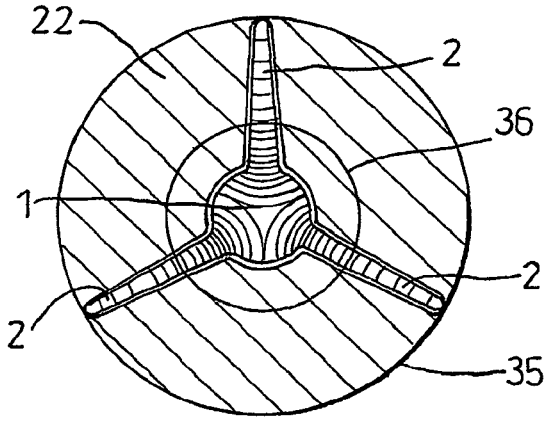

FIG. 1F shows a helical section, similar to that in FIG. 1B, contained in a helical deformation arrangement (22), showing the concentration of stresses represented by curved lines at the root of the fin (2).

Figure 1G:
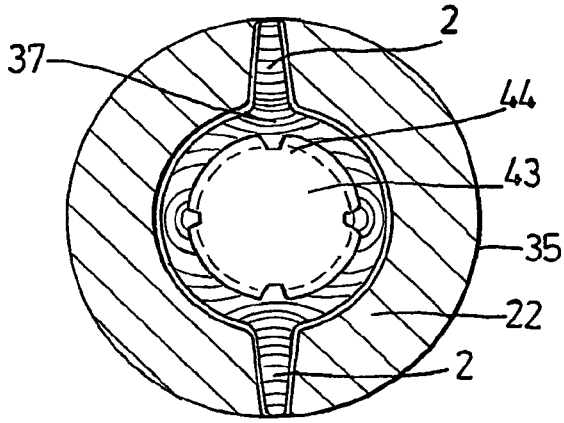

FIG. 1G shows the same section as in FIG. 1C, where the helical section is tubular, with the same pattern of concentrated stresses around the root of the fin (2) represented by curved lines, which, if not contained, would cause cylindrical pinching collapse.

Figure 1H:
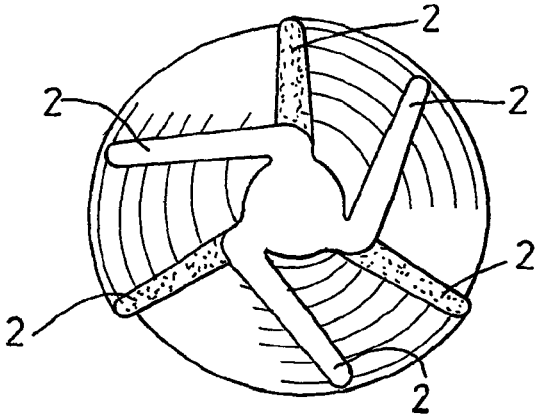

FIG. 1H shows the manner in which a helical section, such as that in FIG. 1F would torsionally fail if twisted freely between two centres while not contained.

Figure 1I:
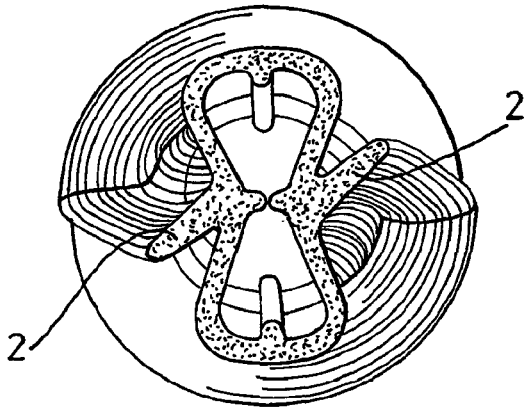

FIG. 1I shows the same torsional failure effect that would occur in the same way when applied to a tubular section.

FIGS. 2 and 2A to 2D are intended to set the scene for subsequent explanations of the importance and advantages of being able to produce finned helical connectors, having constant helix pitches.

FIG. 2A shows a helical section (4) of a connecting device and alongside this an elevation of a length with equal distances between adjacent radial fins. Such constant pitches can only reliably be produced by processing preformed material through a helical deformation arrangement (22). Above the elevation drawing of this length of helically transformed wire is shown in FIG. 2 a set of fin tip locus lines (5) that would be imprinted if a length of helical wire, with a constant pitch distance were rolled through 360 degrees across a surface capable of being indented. It will be seen that these locus lines (5) are all straight, parallel and equidistant from one another.

FIG. 2B shows a similar helical section (4) with two fins opposite to one another in which the helix pitch, as signified by the distances between adjacent fins (6), decreases slightly along the length from left to right. As previously explained, lengths of helically finned wire with non-constant helical pitches are liable to arise when long lengths of wire are conventionally twisted by applying torque at their extreme ends. Above this drawing in FIG. 2E is shown a set of fin-tip locus lines (SB) that would be imprinted if a length of helical wire, of a progressively decreasing helical pitch, were rolled through 360 degrees across a surface capable of being indented. It will be seen that these locus lines (5B) are not parallel or equidistant but become progressively closer and steeper from left to right. These particular locus lines are shown with lines of dots. Also included in this part of the drawing is a copy of the fin-tip locus lines (5) applicable to the length of wire with a regular helix pitch as shown in FIG. 2A. The spaces between the two sets of fin-tip locus lines (5, 5B) have been hatched to show the accumulating discrepancies between the two sets of lines representing the loss of helical interlock culminating in voids (15) shown later.

FIG. 2C shows two lengths of wire of the type shown in FIG. 2A with regular helix pitches nestling closely side by side with one another. If the lower length were to be pushed at its left-hand end (8) towards the right and if the upper length were restrained at its right hand end (9), the intermeshing of the two sets of radial fins would cause the lower length to rotate as it was pushed forwards. Such arrangements for including immediate rotation are very beneficial with helical fixings collated side by side for insertion by nailing guns delivering axial impacts.

FIG. 2D shows a helical fixing with a helical pitch that is irregular side by side with one having a regular pitch. Clearly these cannot intermesh.

Figure 3A:
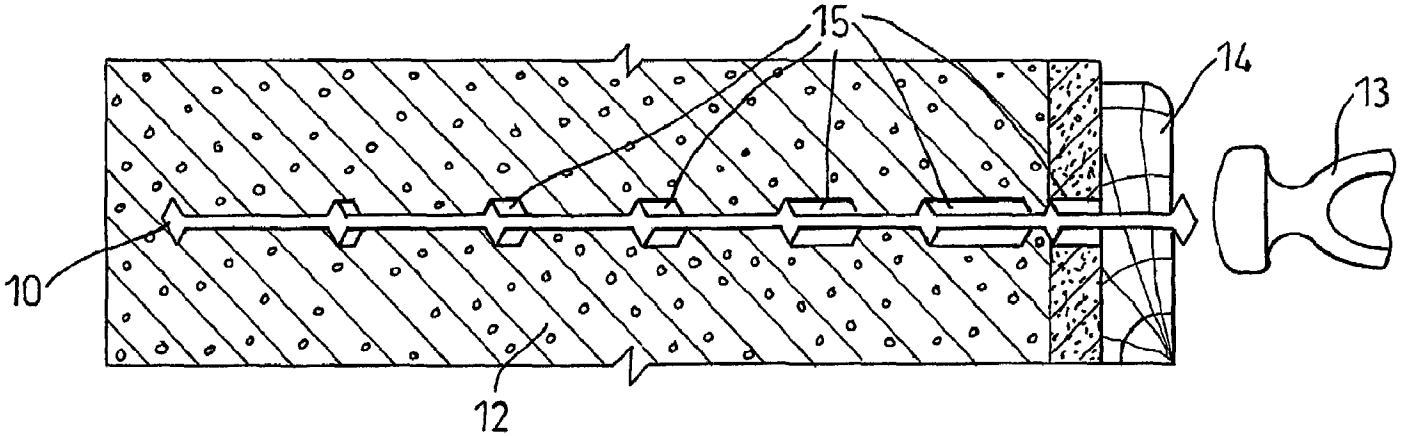
FIGS. 3A and 3B are side sections that illustrate the adverse effects of driving a helical fixing with an irregular pitch into aerated concrete blockwork in comparison to a helical fixing with a regular pitch.

FIG. 3A shows a longitudinal section (10) that is drawn through the central plane of a short length of helically finned wire (10) that has a non-constant helix pitch (6), decreasing from left to right, as shown in FIG. 2B. It is shown embedded in a block of aerated concrete (12), having been driven, with a hand hammer (13), through a thin piece of softwood (14), such as a skirting board. The front part of the fixing, which first entered the block through the skirting board, will have cut helical passages in the softwood board and the adjacent block material corresponding with the helix pitch at the leading end of the fixing. This will have caused the fixing to rotate according to this portion of the pitch. As the leading end continues to penetrate further, it will be followed by parts of the fixing with differing pitches and the helical passages will become widened, tending to "strip" the helical threads progressively behind the leading end as driven. The grip of the fixing into the block will become largely ineffective. The voids (IS) are caused by the helix's non-conformity. It will be appreciated, in the light of this that if a tensile force is applied the effective resulting reactions will be confined to surfaces provided at the far left-hand end only of the connecting device. If the concentration of stress causes failure and the fixing moves, it is unlikely that any of the helical fins closer to the surface will be able to provide any further resistance in a load-sharing manner, as the deflection restraint will vary with the accuracy of pitch connections.

Figure 3B:
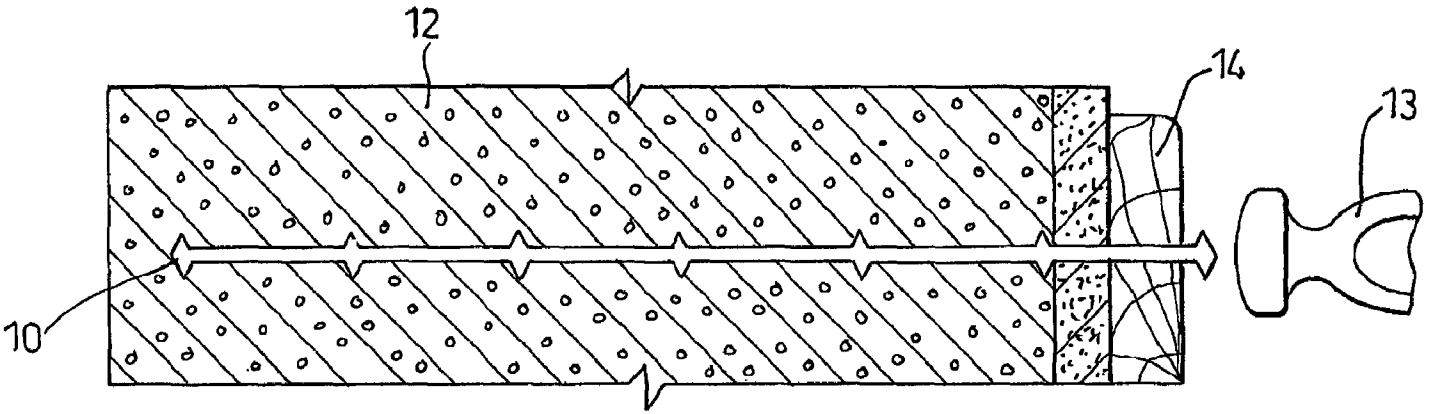

FIG. 3B shows a similar situation to that in FIG. 3A but in this case the helix pitch is constant throughout. It will be seen that the "threads" cut are neat and fully effective throughout, as shown in FIG. 2A, additionally enhancing frictional compaction grip.

Figure 4B:
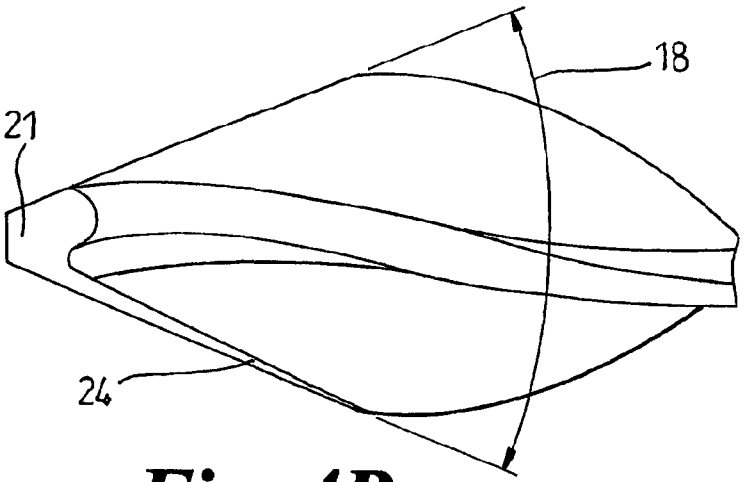
Figure 4C:
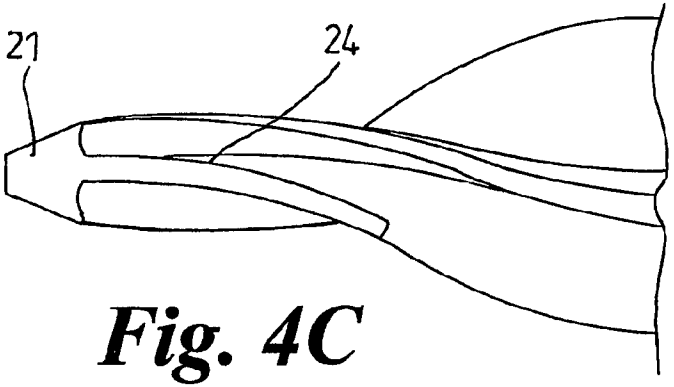
Figure 4A:
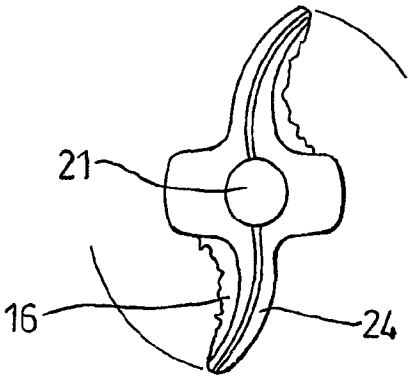

FIG. 4A shows an end elevation of a precisely true helical swept cut (18) profile. Also shown is the effect of grinding flash (16) away from the true helical cut (18) inducing a slackening of the helical mating path.

FIG. 4B shows a plan view elaborating the swept inclusive angle (18) which will be between 20° and 40° inclusive. FIG. 4C shows a side elevation of the stamped point profile (24). It will be noted that along the swept leading edge of the fin it follows a curvature trailing away from the core (21) as shown in FIG. 4A.

Figure 4D:
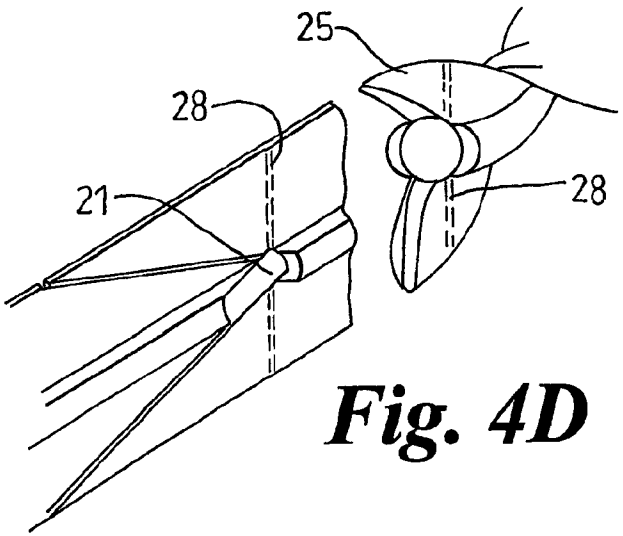

FIG. 4D shows, to the left, points stamped onto a preform member prior to helical deformation, as shown to the right. The operation can provide either a flat end to the preceding component as shown by the dotted line on the fins (28) or one with trailing end tabs (25). The neck configuration (21) can be seen more clearly providing a good swept angle point composition upon the more central core-like material.

Figure 5A:
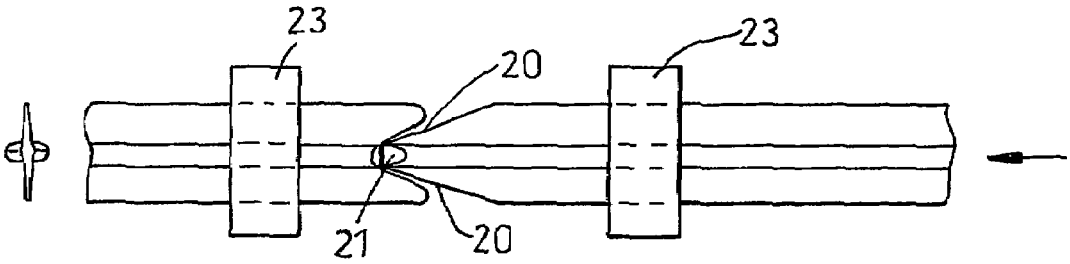

FIG. 5A shows a cross-section and an elevation of a short length of preformed wire, with two fins projecting from a central core. At a point along the elevation, parts of the section are shown to have been stamped away (20) and part of the core at this point is shown to have been indented (21). At both sides of the position where the stamping takes place, guide blocks (23) need to be provided to locate the wire to stamp it accurately and to stop it from buckling as a result of the pushing forces, normally applied by shaping rollers. The preformed and stamped wire has to be pushed through helical deformation arrangements (22), with an internal void with an accelerating helix configuration.

Figure 5B:
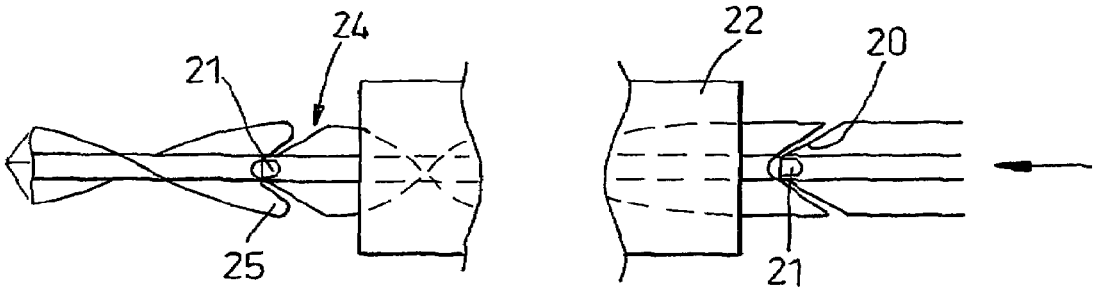

FIG. 5B shows a diagrammatic side view of a length of preformed wire which has been stamped as described with reference to FIG. 5A, being pushed through a helical deformation arrangement (22) comprising a die, in which an internal helical path of compound angles with an accelerating pitch is indicated by dotted lines. At the right hand end of the drawing, a stamped out and indented (20,21) part is shown entering the straight mouth part of the helical deformation arrangement before the helix starts. From there on, the pitch begins and is steadily increased to a maximum at the exit end. Beyond this arrangement is shown a helical deformed version of the stamped and indented part. It will be clearly seen that this now forms an arrow-shaped head (24) a snap-off indented neck point (21) and trailing end tabs (25) of fin material.

Figure 5C:
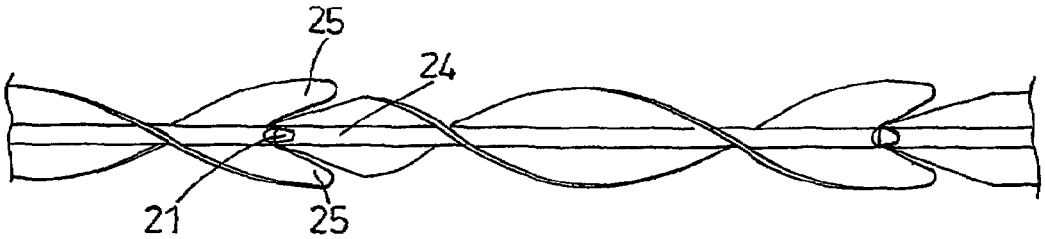

FIG. 5C shows a short length of helical fixing ready to be separated for use. The particular usefulness of trailing end fin tabs (25) is explained later with reference to FIG. 14.

Figure 5D:
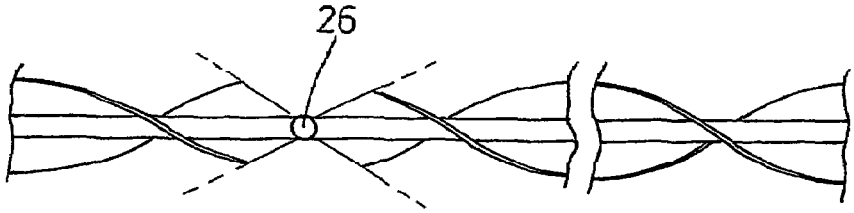

FIG. 5D shows a differently shaped snap-off neck (26) whereby both ends of a connector have the same chevron profile. Various other end shapes, suitable for different purposes can be made with these methods, provided that the helix is formed via a helical deformation arrangement.

FIG. 6A shows a hollow extruded dowel type connector where the core is cylindrical (36). The preform member is pre-stamped prior to helical deformation with a swept angle point (18), which deforms a neck (21) bevel onto the cylindrical core (36).

FIG. 6B shows the effect of point profile on the substrate material in terms of the compaction pressure waves (52) created and shown by layers of black curved lines. The upper part of the drawing shows how the spike like point profile creates a compaction pressure wave (52) that resembles the wave pattern on the bow of a boat creating an over widened path of disturbance. In terms of fastening principles this means the substrate material abutting the core of the fastening and central helical interlock is compaction failed and weakened. The lower part of the drawing shows a blunt end nose (29) profile, which creates far less compaction (52) forces, which themselves tend to be more forward focussed within a closer core path. The fins on the swept angle (18) create a smooth entry passage and positive grip.

FIG. 6C shows a connector driven through a timber element on the right, in and on into an aerated concrete block (12) on the left. It will be seen that the spike like profile point has caused the timber fibres to drag and slither apart and the aerated concrete to compact and crush substantively around the core shown by darkened shading.

FIG. 7 shows one arrangement by which serrations can be applied to the faces of the ribs (3), by means of grooved rollers (60). Rolled serrations could be applied to any surface of the section providing an additional withdrawal grip to complement the helical interlock.

FIG. 8 shows the benefits regarding torsional surface areas (38) and smooth mating of profile geometries with well radiused forms for the fins (2) and ribs (3).

FIG. 9 shows an arrangement by which the tubular helical sections, as shown in FIG. 1G, can be processed into conically pointed sections for uses such as plugs and dowels used in lightweight building materials. The helical deformed section, with an exact conforming helical pitch, is fed through a precisely mating guide block (23) that firmly restrains the section as orbiting bevelled milling cutters (55) form a conical neck on the tubular section.

FIG. 10A shows how a wire form being deformed with an open helix (35) can be used with lower strength materials, such as mortar (49) and grouts (50) in the confined application of laid and raked out mortar beds (46). The mortar (49) or grout (50) can flow (45) easily around the open helical form providing a reliable helical wave interlock (44) where the end use of alternative axial finned profiles may otherwise cause air pocket voids.

The helical wave (43) provides an optimum balance of interlock (44) between the grout (50) or mortar (49), the strength providing a geometric mechanical balance. The helical form has a natural geometric elastic profile enabling the composite grout/mortar reinforcement layer to flex under high tensile (47) and compressive (48) loads. Such loads are present in seismic stresses and the composite is capable of full recovery after considerable movement. Such uniquely manufactured reinforcement will provide the uniformity of pitch to fully flex and recover.

FIG. 10B shows an isometric view of the open helical form (35) that demonstrates the extent of the helical wave interlock (44) shown as an circumscribed cylinder. Also demonstrated is the dramatic extent to which the reinforcement rods nestle and interlock, enabling efficient overlap jointing.

FIG. 10C shows a cross sectional view that reveals the extent of the helical wave interlock (44).

FIG. 11A shows a triangular helical section where the helix is open. That is to say it is non axial about its centre though there is common axial core material (1). This form of helix, which is vaguely similar to an elongated cork screw, can only be produced by such a helical deformation arrangement as it has no axial line of torsional symmetry. Both this and the section in FIG. 12 have a high interlocking characteristic into the materials they connect due to accentuated gyrational form ideal for weaker substrate reinforcement.

FIG. 11B shows a means of cross connecting reinforcement sections via a substantive helical interlock, retained by a simple clip arrangement (51) shown as a dotted line.

FIGS. 12A and 12B show the same arrangement as FIG. 11A where the section is of a circular form.

FIG. 13 shows, by way of comparison, a conventional reinforcing rod which has considerable cross section mass in relation to its effective circumscribed diameter (35) which provides little interlock bond especially in relation to weaker substrates.

FIG. 14 shows a connector with end tabs for use in securing a composite layer (17) to an aerated concrete block wall (12). With this application of the helical connector a metal load-spreading press on clip or washer-like retaining head is provided. This washer could also be made of injection moulded plastics materials. The tabbed ends (25) will lock against the surface of the washer-like head when it is fully driven in through a simple key-hole slot (27), corresponding with the sectional shape of the fixing. When the tabs (25) at the end are hit by a driving tool, they will be bent down to lie in the same plane as the surface of the washer-like retaining head, so that they will effectively clamp it in position. It will be appreciated that, if the leading end of a fixing (24) with a constant helical pitch, starts to be driven through a tightly fitting key-hole slot (27), the fixing will immediately be rotated at the correct rate to suit the seatings or "threads" to be cut in the soft materials as the helical form penetrates further.

FIG. 15 shows a collated belt of fixings lying in a cylindrical container (34) with an outlet duct. A fixing (30) is in a position to be driven into a timber component joint or into layers of composite building materials to be secured together by a nailing machine. At the centre of the cylindrical container (34) is a spool (33) around which the band of collated fixings has been wrapped and this can be rotated (as indicated by arrows) to assist in discharging the fixings.

FIG. 16A shows an end section drawn through a reinforced concrete member, such as an I-beam or a mullion. There are two pairs of longitudinal helical reinforcement wires (40), one pair at the top and one pair at the bottom. The upper and lower pairs of longitudinal reinforcement wires are connected together by means of transverse wires (41) of the same configuration. It will be seen that the transverse wires (41) are effectively sandwiched between the pairs of longitudinal wires (40) so that their helical fins securely lock together and can be readily wired or clipped accurately together at their intersections. Once the concrete (42) has set, such structural connections will be absolutely secure. It will be seen by looking at the drawings that regularity of helical pitch is essential for these purposes in setting accurate pre-determined pitch increment modules.

FIG. 16B shows a plan view of the reinforcement cage

FIG. 17A shows the helical acceleration path of a typical helical deformation arrangement (22) through the forty plus angular increments represented by a vertical distance of a half pitch (53), the helical distance of a 180° rotation. To scale, this arrangement would reveal a full pitch rotation of approximately 50 mm to 60 mm. The lower part of the drawing shows a minimum set of nine helical broaching tools (54) required to rough out the forty plus deflection nodes. These tools correspond, in stages, to the shape of the internal profile of the deforming arrangement. At the inlet side, on the left, there would be required a small number of straighter tools.

FIG. 17B shows the other two sets of angular paths (56, 57) that have to be incorporated within the overall three-dimensional angle of the internal path of the helical deformation arrangement (22). The upper right drawing shows the inclining angle (57) at the radial extremes, which have to be accommodated as the preform member is forced through the deformation arrangement (22) in the direction of the central arrow, indicating the central core axis. This inclining angle (57) is a result of the increase in the helix angle when induced outwardly from the core (1). The effect is shown on the lower diagram where the fins (2), flanges or ridges are sectioned out progressively from left to right to reveal the helical angles (56) at radial increments.

According to a preferred embodiment, the invention provides a helically profiled connecting device or reinforcement in the form of a preformed wire, rod or hollow extrusion with a common axial core material cross section of two-fifths or less of the circumscribed cross sectional area, that being deformed via means of a progressive acceleration of helical compound angles forming a distributed twisting path of surface deflection, the tightness of helical pitch being one fill 360° rotation within a distance of five and a half circumscribed profile diameters or less, the accuracy of pitch being plus or minus 0.5% along the axial measurements on any given probate pitch.

Advantageously, the preform wire, rod or hollow extrusion is stamped substantially through prior to helical deformation as described above, the stamped profile providing a swept angle of between 20° and 40° inclusive, and a flat nose end corresponding to between 90% and 40% of the common axial cross section, with the entire stamped edge falling inside the original helical profile path after subsequent deformation.

The wire, rod or hollow extrusion may stamped in such a manner that the stamped profile provides trailing and projecting tabs of material upon the fin material ends, these subsequently folding over flat when hammered. The wire, rod or hollow extrusion may contain two or three major fins leading from a central core.

Preferably, the invention also provides a method of producing helically deformed sections of a highly profiled structure, through surface deflection, upon an accelerating path, incorporating the multitude of helical compound angles. Such a path profile enables the smooth passage of non-uniform sections whilst holding it to an accuracy of helical pitch of one half of one percent when measured along the central axis.

The invention claimed is:

1. A method of manufacturing a helical connecting device, the method comprising:

forcing an elongate preform member through a helical deformation arrangement in order to deform the preform member helically, wherein the preform member includes a plurality of weakened zones; and, breaking the deformed preform member at the weakened zones to provide a plurality of connecting devices.

2. A method according to claim 1, in which the deformation arrangement has an accelerating pitch, whereby the deformation of the preform member increases as it is forced through the arrangement during said forcing step.

3. A method according to claim 1, in which the deformation arrangement includes a substantially straight entry portion, and wherein said forcing step comprises forcing said elongate preform member through said entry portion.

4. A method according to claim 1, in which the deformation arrangement includes an exit portion of substantially constant pitch, and wherein said forcing step comprises forcing said elongate preform member through said exit portion.

5. A method according to claim 1, in which the deformation arrangement comprises a twisting die, and wherein said forcing step comprises forcing said elongate preform member through said twisting die.

6. A method according to claim 5, in which the twisting die has a continuous die passageway.

7. A method according to claim 1, in which the weakened zones are shaped such that each connecting device includes at least one sharpened end.

8. A method according to claim 1, in which the preform member is forced through the helical deformation arrangement by means of drive rollers.

9. A method according to claim 1, in which the preform member has a central core and a plurality of substantially planar fins, the method comprising forcing the preform member through the helical deformation arrangement in order to deform the preform member helically about the central core, such that the helical connecting device has an axial core and a plurality of helical fins that extend outwards from the axial core.

10. A method according to claim 1, in which the preform member includes a rod-like member, the method comprising forcing the preform member through the helical deformation arrangement in order to deform the preform member into an open helix.

11. A method according to claim 10, in which the diameter of the rod-like member is greater than the external radius of the helical connecting device.

12. A method according to claim 10, in which the rod-like member has a circular cross-section.

13. A method according to claim 10, in which the rod-like member has a polygonal cross-section.

14. A method according to claim 1, wherein the elongate preform member comprises wire and the helical deformation arrangement includes grooved rollers and a twisting die; the method further comprising:

continuously feeding the wire from a coil of the wire through the grooved rollers, wherein the grooved rollers are arranged to produce a profiled wire having first and second fins and first and second stubby reinforcing ribs extending from a central core, each of the first and second fins tapers from a radiused root to a tip and has a larger radial length than the first and second stubby reinforcing ribs, the first and second stubby reinforcing ribs are arranged alternately with the first and second fins, and the maximum cross-sectional width of each of the first and second fins is less than the diameter of the central core of the profiled wire.

15. A method according to claim 14, including continuously feeding the profiled wire to the twisting die and forcing it there through to produce a helically profiled wire in which the accuracy of the pitch of the helical projections formed from the first and second fins varies by no more than 0.5% from any given probate pitch along the axis of the wire.

16. A method according to claim 15, including cutting the helically profiled wire to produce helical connecting devices having a helical profile extending along substantially the whole length of an axial core.

17. A method of manufacturing helical connecting devices, the method comprising:

forcing an elongate preform member through a helical deformation arrangement in order to deform the preform member helically, wherein the elongate preform member comprises wire and the helical deformation arrangement includes grooved rollers and a twisting die;

continuously feeding the wire from a coil of the wire through the grooved rollers, wherein the grooved rollers are arranged to produce a profiled wire having first and second fins and first and second stubby reinforcing ribs extending from a central core, each of the first and second fins tapers from a radiused root to a tip and has a larger radial length than the first and second stubby reinforcing ribs, the first and second stubby reinforcing ribs are arranged alternately with the first and second fins, and the maximum cross-sectional width of each of the first and second fins is less than the diameter of the central core of the profiled wire;

continuously feeding the profiled wire to the twisting die and forcing it there through to produce a helically profiled wire; and cutting the helically profiled wire to produce helical connecting devices having a helical profile extending along substantially the whole length of an axial core, wherein the accuracy of the pitch of the helical projections formed from the first and second fins varies by no more than 0.5% from any given probate pitch along the axis of the wire.

18. A method according to claim 17, wherein the twisting die is arranged to twist the wire by acting on only the first and second fins.

19. A method according to claim 18, wherein the preform member includes a plurality of weakened zones, and breaking the deformed preform member at the weakened zones to provide a plurality of connecting devices.

20. A method of manufacturing helical connecting devices, the method comprising:

forcing an elongate preform member through a helical deformation arrangement in order to deform the preform member helically, wherein the helical deformation arrangement comprises a twisting die and the elongate preform member comprises a coil of profiled wire having first and second fins and first and second stubby reinforcing ribs extending from a central core, each of the first and second fins tapers from a radiused root to a tip and has a larger radial length than the first and second stubby reinforcing ribs, the first and second stubby reinforcing ribs are arranged alternately with the first and second fins, and the maximum cross-sectional width of each of the first and second fins is less than the diameter of the central core of the profiled wire;

continuously feeding the profiled wire to the twisting die and forcing it there through to produce a helically profiled wire; and cutting the helically profiled wire to produce helical connecting devices having a helical profile extending along substantially the whole length of an axial core, wherein the accuracy of the pitch of the helical projections formed from the first and second fins varies by no more than 0.5% from any given probate pitch along the axis of the wire.

21. A method according to claim 20, wherein the twisting die is arranged to twist the wire by acting on only the first and second fins.

22. A method according to claim 20, wherein the preform member includes a plurality of weakened zones, and breaking the deformed preform member at the weakened zones to provide a plurality of connecting devices.

* * * * *